US005743244A

United States Patent [19]

Bush et al.

[11] Patent Number: 5,743,244

[45] Date of Patent: Apr. 28, 1998

[54] FUEL CONTROL METHOD AND SYSTEM WITH ON-LINE LEARNING OF OPEN-LOOP FUEL COMPENSATION PARAMETERS

[75] Inventors: Kevin J. Bush, Northville; Darren A. Schumacher, Ypsilanti; Bruce A. Church, Dearborn, all of Mich.

[73] Assignee: Motorola Inc., Schaumburg, Ill.

[21] Appl. No.: 751,291

[22] Filed: Nov. 18, 1996

[51] Int. Cl.[6] ..... F02D 41/00; F02M 23/00

[52] U.S. Cl. ..... 123/674

[58] Field of Search ..... 123/674, 480, 123/492, 478; 60/276; 364/431.06, 431.05

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,481,928 | 11/1984 | Takimoto et al. | 123/492 |
| 4,939,658 | 7/1990 | Sekozawa et al. | 364/431.06 |
| 5,318,003 | 6/1994 | Kadota | 123/674 |
| 5,335,493 | 8/1994 | Uchida et al. | 60/274 |
| 5,448,978 | 9/1995 | Hasegawa et al. | 123/480 |
| 5,464,000 | 11/1995 | Pursifull et al. | 123/674 |
| 5,615,550 | 4/1997 | Ogawa et al. | 60/276 |

FOREIGN PATENT DOCUMENTS 0152019 8/1985 European Pat. Off. .

63-24483 2/1988 Japan .

OTHER PUBLICATIONS

"Real Time Engine Control Using STR in Feedback System" by Maki, Akazaki, Hasegawa, Komoriya, Nishimura and Hirota, Honda R&D Co., Ltd. 1995.

"Adaptive Air–Fuel Ratio Control of a Spark–Ignition Engine" by Ault, Jones, Powell, and Franklin, Stanford University, 1994.

"An Adaptive Fuel Injection Control with Internal Model in Automotive Engines" by Inagaki, Ohata, and Inoue, Toyota Motor Corporation.

*Primary Examiner*—Raymond A. Nelli

*Attorney, Agent, or Firm*—Nicholas C. Hopman

[57] ABSTRACT

A method and system for fuel delivery to an engine (400) measures when an exhaust gas sensor (413) is in a non-lit-off condition and when the exhaust gas sensor is in a lit-off condition. A control device (409) estimates fuel puddle dynamics for an intake system of the engine when the exhaust gas sensor is in the lit-off condition, and adapts (511) an open-loop fuel parameter table (229) dependent on the estimated fuel puddle dynamics. The control device (409) adjusts fuel delivery to the engine dependent on the fuel puddle dynamics when the exhaust gas sensor is in the lit-off condition, and adjusts fuel delivery to the engine dependent on the open-loop fuel parameter table (229) when the exhaust gas sensor is in the non-lit-off condition.

12 Claims, 5 Drawing Sheets

$m_f$: FUEL FILM MASS $m_{dep}$: FUEL MASS DEPOSITED IN FILM $m_v$: FUEL VAPOR FROM FILM $m_i$: FUEL MASS INJECTED $m_c$: FUEL MASS ENTERING CYLINDER c: FUEL FRACTION PARAMETER $b_v$: FUEL FILM VAPORIZATION PARAMETER k: ENGINE CYCLE INDEX $$m_f(k) = m_f(k-1) + m_{dep}(k) - m_v(k)$$

$$m_{dep}(k) = c\,m_i(k)$$

$$m_v(k+1) = b_v m_f(k)$$

$$m_c(k) = (1-c)m_i(k) + m_v(k)$$

$m_f$: FUEL FILM MASS $m_{dep}$: FUEL MASS DEPOSITED IN FILM $m_v$: FUEL VAPOR FROM FILM $m_i$: FUEL MASS INJECTED $m_c$: FUEL MASS ENTERING CYLINDER c: FUEL FRACTION PARAMETER $b_v$: FUEL FILM VAPORIZATION PARAMETER k: ENGINE CYCLE INDEX $$m_f(k) = m_f(k-1) + m_{dep}(k) - m_v(k)$$

$$m_{dep}(k) = cm_i(k)$$

$$m_v(k+1) = b_v m_f(k)$$

$$m_c(k) = (1-c)m_i(k) + m_v(k)$$

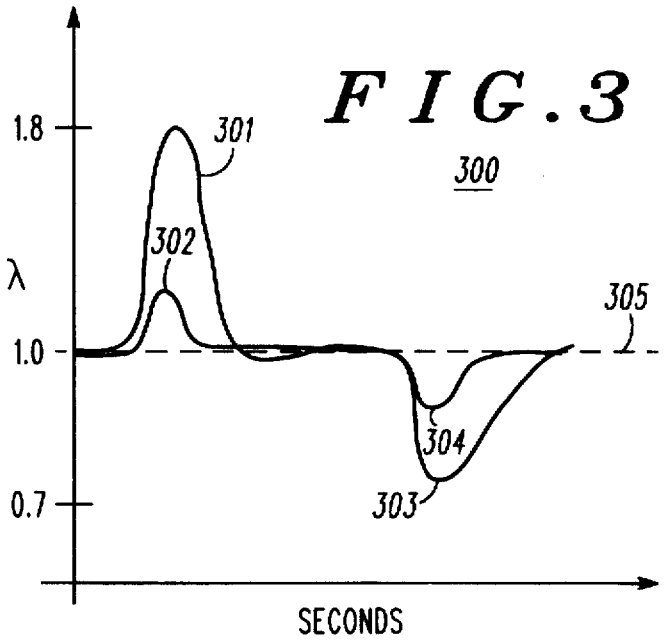
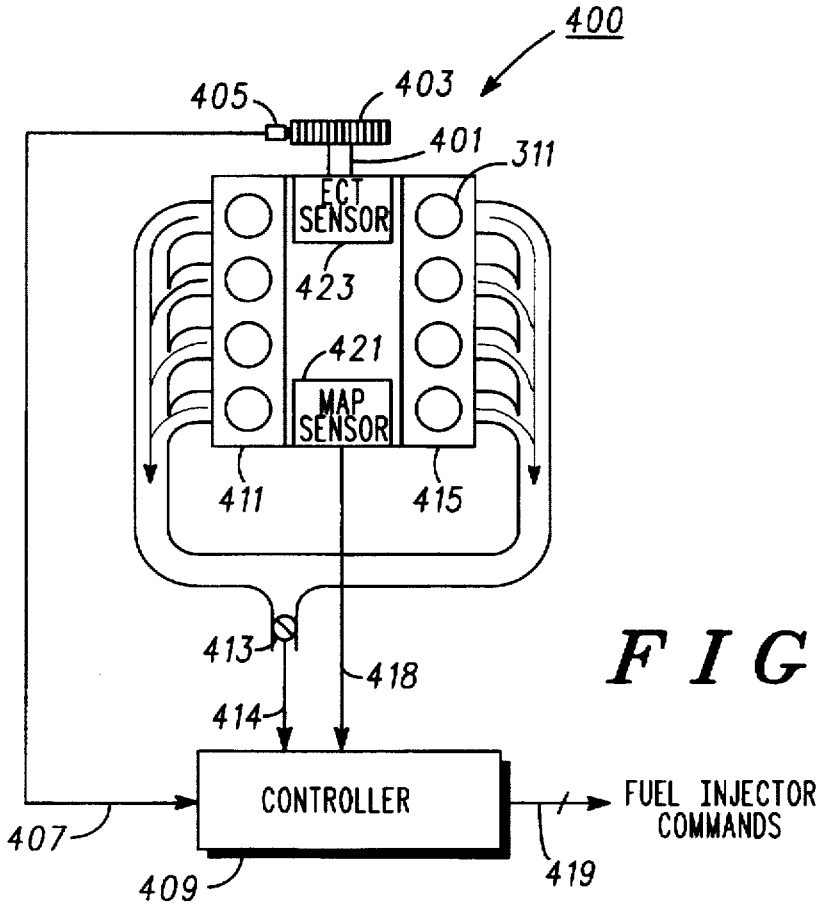
FIG. 4

FUEL CONTROL METHOD AND SYSTEM WITH ON-LINE LEARNING OF OPEN-LOOP FUEL COMPENSATION PARAMETERS

FIELD OF THE INVENTION

This invention is generally directed to the field of engine control, and specifically for fuel control in a spark ignited engine.

BACKGROUND OF THE INVENTION

Contemporary spark ignited internal combustion engines are controlled by electronic devices to control emissions of pollutants into the atmosphere. Environmental legislation continually requires stricter limitations on emissions from those engines in automotive applications. To reduce emissions from a spark ignited internal combustion engine, precise control of combustion air/fuel ratio is necessary. This is usually done by metering a precisely controlled amount of fuel based on a measured or inferred air charge mass ingested into the engine. Many control schemes currently control air/fuel ratio, but with less accuracy than necessary. Precise control is difficult because of a deposit, and subsequent evaporation of the deposit, of fuel on the walls of an intake manifold and on intake valves of the engine. This phenomena is sometimes referred to as wall-wetting. To achieve accurate control of the fuel delivered for combustion, fuel behavior associated with the wall-wetting phenomena must be accurately compensated. Furthermore, the bulk of the hydrocarbons exhausted from an engine are exhausted when the engine is cold—such as in a starting condition before associated exhaust gas sensors are heated sufficiently to provide closed-loop (feedback) fuel control, and before an exhaust system mounted catalytic converter is heated sufficiently to catalyze the exhausted hydrocarbons.

Wall-wetting behavior is dynamic and has been characterized by two parameters corresponding to a fraction of injected fuel that is deposited into a film or puddle on a backside of the intake valves and the walls of the intake manifold, and a fraction of the fuel film evaporating from the film between one engine cycle and the next (alternatively, a continuous time interpretation of these two parameters has also been used). These two parameters vary with engine operating conditions such as engine speed, load, and temperature. These two parameters also vary over time with engine age, engine intake valve deposits and fuel composition, making it difficult to compensate for wall-wetting with consistent accuracy.

Some prior art schemes have addressed these difficulties by using measurements and estimates of fuel system dynamic behavior to identify these two parameters on-line during normal (closed-loop) engine operation. These identification algorithms, however, require an exhaust gas sensor signal, which is unavailable during cold starts, making it impossible to directly apply these methods to the reduction of cold start emissions.

In most prior art schemes cold start wall-wetting parameters are experimentally mapped as functions of engine speed, engine load and engine coolant temperature and stored in tables for use in controlling an engine during cold starts. The mapping is usually performed on a single prototype engine that may exhibit behavior not representative of every mass-produced engine and is then applied to mass produced engines. Often the prior art schemes rely on ad-hoc/experimentally determined temperature correction factors to compensate for temperature effects, with only limited success. Also, with the long term aging effects, such as the accumulation of intake valve deposits, the control accuracy and hence the cold start emissions of the engine deteriorate significantly with age. Emissions deterioration as the engine ages is now an important problem since the 1990 amendments to the Clean Air Act increased the emissions durability requirements to 100,000 miles.

In summary, prior art schemes do not accurately take engine age and engine valve deposits into account during an engine's cold starting condition (before an exhaust gas sensor signal is available (i.e. when the engine is being controlled in an open-loop mode)). Therefore, what is needed is a more accurate cold start fuel compensation approach for a spark ignition engine that adjusts for engine age and intake valve deposits.

BRIEF DESCRIPTION OF THE DRAWING

FIG. 3 is a chart illustrating the effect of mapped wall-wetting compensation on transient air/fuel ratio in the presence of engine intake valve deposits vs. the effect of mapped wall-wetting compensation on transient air/fuel ratio for identical throttle transients on the same engine without engine intake valve deposits;

FIG. 4 is a schematic diagram of a system hardware platform;

DETAILED DESCRIPTION OF A PREFERRED EMBODIMENT

A method and system for on-line open-loop transient fuel compensation tuning for an engine uses a learning algorithm to modify an open-loop fuel parameter map or schedule, in the form of a table stored in memory, by obtaining information from an algorithm which identifies fuel puddle dynamics on-line and on a cycle-by-cycle basis for the engine, by estimating parameters of a wall-wetting dynamic model during closed-loop operation of the engine. The updated table may then be used by a wall-wetting compensator to adjust fuel delivery to the engine dependent on the learned fuel puddle dynamics. Since the open-loop fuel parameter table is continually updated while the engine is running in a closed-loop mode, the engine's open-loop emissions performance will be greatly improved over prior art schemes because engine aging symptoms—such as intake valve deposits and engine wear will be effectively compensated.

So, by implementing the essential structure just described a more accurate open-loop (cold start/crank) fuel compensation approach for a spark ignition engine that accounts for time varying fuel injection dynamic behavior due to causes such as engine operating conditions and engine age without requiring excessive computational resources can be constructed. The structural approach detailed below modifies an open-loop fuel parameter table, or base stored tabular values, of wall-wetting parameters by utilizing the outputs of an algorithm which identifies wall-wetting parameters corresponding to an amount of fuel deposited, and a subsequent amount evaporated per engine cycle, on walls of an intake manifold and on intake valves of the engine and uses this information to accurately compensate for the open-loop wall-wetting dynamics by controlling delivery of fuel to the engine. The goal of this novel compensation method are to reduce the normalized air/fuel ratio (lambda) deviations away from stoichiometry (lambda equals one) in the exhaust stream which occur during engine transients during open-loop engine operating conditions, using a computationally efficient approach that can be easily implemented.

Before detailing specific structures for constructing the preferred embodiment a little theoretical background would be useful to fully appreciate the advantages and alternative structures.

Model Description

Figure 1:
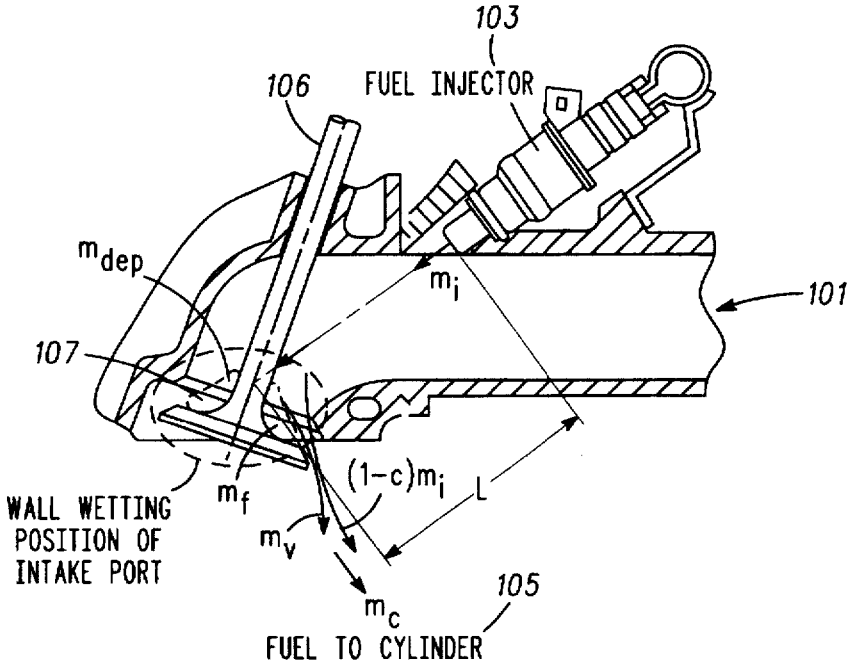
FIG. 1 is a schematic diagram of a fuel film (wall-wetting) model.

FIG. 1 is a schematic diagram of a fuel film (wall-wetting) dynamic model useful for representing an amount of fuel deposited, and a subsequent amount evaporated per engine cycle, on walls of an intake manifold 101 and on intake valves 106 of the engine. The illustrated model is characterized by two parameters, c and $b_v$. A parameter c denotes a mass fraction of fuel 107 from a given fuel injection event that adheres to (puddles on) the manifold walls 101, intake valves 106, or other structure preventing the full injected fuel charge from reaching the cylinder's combustion chamber. Note that if c is equal to one, none of the fuel from an injector 103 feeds through directly to the fuel charge 105 in that cylinder for that engine cycle. A second parameter $b_v$, denotes a mass fraction of the puddle 107 that evaporates during a given engine cycle. The illustrated model has an advantage of being based in the crankshaft angle domain, which means that in a sampled-data type system, a sampling rate does not appear in the system dynamics.

Adaptive-Learning Control Strategy

An essential approach of a control strategy employed here is learning control combined with adaptive control. By identifying the wall-wetting model parameters c and $b_v$ on-line, an amount of fuel injected can be modified so as to adaptively compensate for the effects of wall-wetting on the combustion fuel charge, making it possible to maintain a stoichiometric air/fuel ratio in the cylinder for combustion even under transient engine operating conditions, unaffected by engine aging, fuel composition, and engine temperature. The identified parameters, c and $b_v$, allow the compensation tuning to be adapted (adjusted) to match the time varying engine dynamic behavior. For a given closed-loop engine operating condition, the estimate of the wall-wetting parameter c (denoted $\hat{c}$) and the estimate of the wall-wetting parameter $b_v$ (denoted $\hat{b}_v$), are input to a learning algorithm, which updates the open-loop fuel parameter table stored in memory in the engine controller. This open-loop fuel parameter table is indexed as a function of engine speed, engine load, and engine (coolant) temperature. The table may also be indexed as functions of other variable sets without departing from the essential teaching of this embodiment. The resulting parameters, cbase and $b_v$base, from the updated tables are then used to tune the wall-wetting compensator during open-loop operation (for example, during crank and cold starts).

The wall-wetting compensation taught here uses a feed-forward compensation approach. The amount of desired fuel to match an estimated air charge is input to the compensation method to calculate an amount of fuel to inject to a cylinder in an immediate, proactive control action. Preferably, feed-forward control is used for transient compensation because the transport and sensing delays of the control system limit the bandwidth of the error-driven feedback loop, making adaptive cycle-by-cycle feedback compensation ineffective for fast transient changes in charge air mass. Other wall-wetting compensation approaches such as adaptive feedback could be utilized without departing from the essential teaching of this embodiment. A schematic of the control strategy is shown in FIG. 2.

Figure 2:
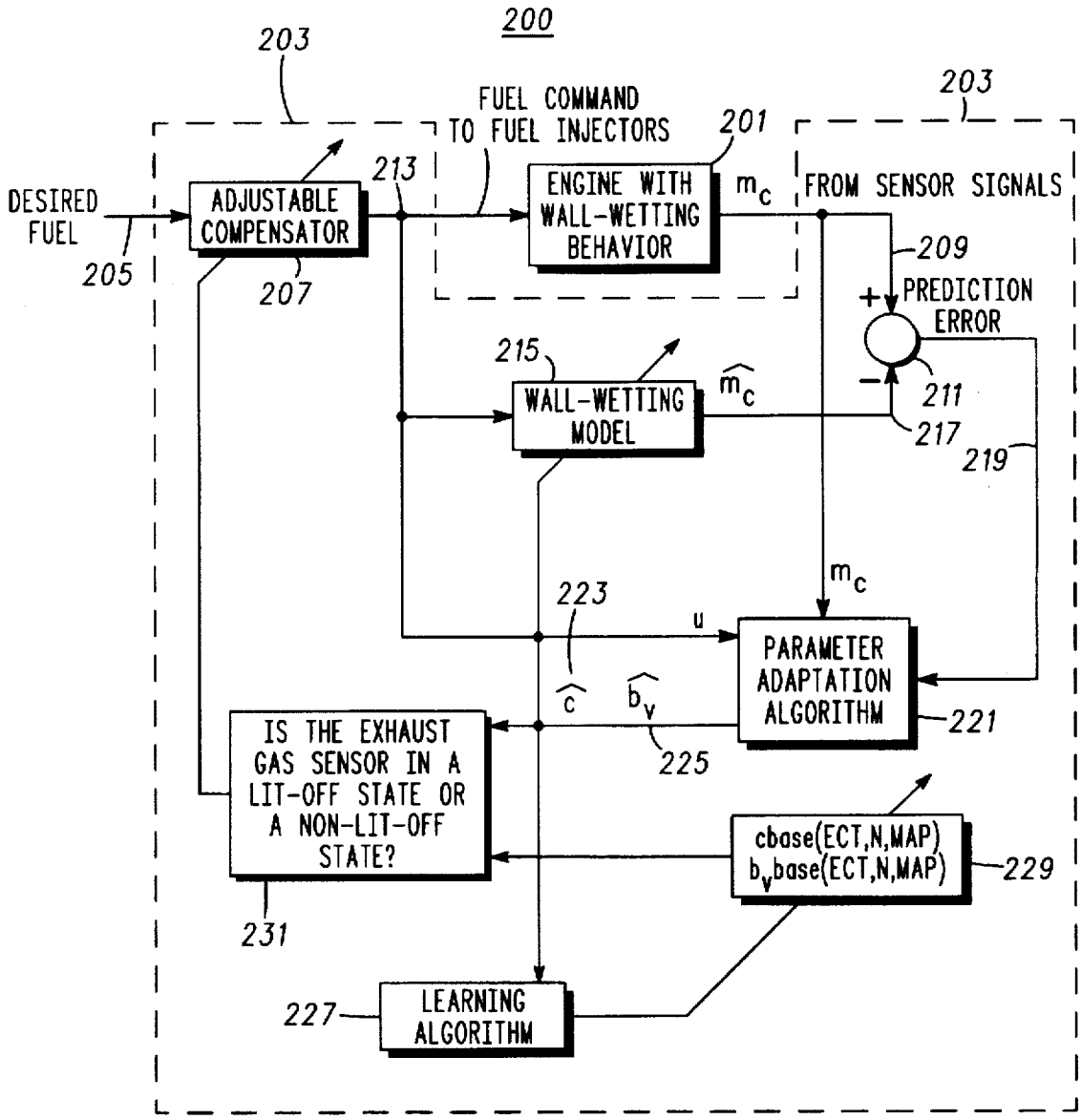
FIG. 2 is a schematic diagram of a learning algorithm process coupled with an adaptive controller in accordance with a preferred embodiment of the invention.

FIG. 2 is a schematic diagram of an adaptive-learning controller 203 in accordance with the preferred embodiment of the invention. The adaptive-learning controller 203 is characterized by several components comprising, an adjustable compensator 207, a wall-wetting model 215, a parameter adaptation algorithm 221, a learning algorithm 227, an open-loop fuel parameter table 229, and a selection device 231. The open-loop fuel parameter table 229 essentially stores a schedule of crank startup transient fuel compensation model parameter values or gains in terms of c and $b_v$ indexed by at least one abscissa comprising engine speed, engine load, and engine temperature. When the engine is running in a closed-loop mode (in other words, when the engine's exhaust gas sensor is lit-off and thus the engine's control system has an error signal available for feedback), a selection device 231 enables the adjustable compensator 207 to periodically receive estimates $\hat{c}$ 223 and $\hat{b}_v$ 225 from the parameter adaptation algorithm 221. The adjustable compensator 207 then adjusts fuel injected 213 into an engine 201 dependent on the parameter estimates $\hat{c}$ 223 and $\hat{b}_v$ 225, and a desired fuel demand 205. The desired fuel demand 205 includes demand from an operator of a vehicle powered by the engine 201, as well as from other control strategies—such as cruise control.

The adjustable compensator 207 is a lead-type compensator 207, that cancels wall-wetting dynamics. The wall-wetting model 215 is used to estimate the value of the system output 209 based on the estimates c 223 and $b_v$ 225 respectively. The wall-wetting model 215 used in the preferred embodiment is detailed in FIG. 1. Other wall-wetting models could be employed in similar fashion, including continuous time models, discrete models with varying sample rates, and continuous or discrete time models including higher order dynamic effects.

Also, during closed-loop engine operation, an estimated value of the system's output 217 is subtracted from a measured system output 209 for the current combustion cycle to obtain a prediction error 219. The prediction error 219 is then utilized by the on-line parameter adaptation algorithm 221 in order to update the estimates $\hat{c}$ 223 and $\hat{b}_v$ 225. The estimates $\hat{c}$ 223 and $\hat{b}_v$ 225 are then passed to the learning algorithm 227 which uses these estimates $\hat{c}$ 223 and $\hat{b}_v$ 225, to modify the base open-loop fuel parameter table 229.

During open-loop engine operation (when the exhaust gas sensor is not lit-off—thus before the fuel control strategy is able to employ feedback using the exhaust gas sensor derived error signal), the selection device 231 uses the modified base open-loop fuel parameter table 229 to provide the estimates $\hat{c}$ 223 and $\hat{b}_v$ 225 to the adjustable compensator 207, which cancels the effects of the wall-wetting dynamics during open-loop operation (although to be consistent with the notation used earlier, the estimates provided by the open-loop fuel parameter table should be denoted cbase and $b_v$base). By coupling a learning algorithm 227 with a parameter adaptation algorithm 221, the effects of the wall-wetting dynamics 201 can be compensated over the life of the vehicle during crank and cold starts, thereby reducing emissions and extending emissions system durability and performance. Note that quantities other than the physical wall-wetting model parameters (such as controller gains) could be stored for open-loop use without departing from the fundamental teaching of this embodiment.

Note that the determination of the exhaust gas sensor state (i.e. whether or not the sensor is in a lit-off condition, or a non-lit-off condition) is accomplished by monitoring a level of activity in the sensor signal, and/or by waiting for a predetermined time period after the engine is started. Other methods of determining sensor state could be utilized without departing from the fundamental teaching of this embodiment.

Parameter Identification

For the purposes of this preferred embodiment, it is assumed that the parameter adaptation algorithm identifies the wall-wetting parameters on a cycle-by-cycle basis. Furthermore, the mechanism for providing real-time (or approximately real-time) estimates of the wall-wetting or other dynamic parameters may be accomplished by a variety of means, any of which may be incorporated into the preferred embodiment without departing from the essential teaching of this embodiment.

If the base open-loop fuel table is indexed as a function of engine speed (N), engine coolant temperature (ECT) and manifold absolute pressure (MAP), which is a commonly used measure of engine load, and contains values for the wall-wetting parameters cbase(ECT,N,MAP) and $b_v$base (ECT,N,MAP), then these values may be updated using the closed-loop real-time estimates of the wall-wetting parameters provided by the parameter identification algorithm $\hat{c}(k)$ and $\hat{b}_v(k)$, where k is an engine cycle index (e.g. for a k of 13 the engine is operating in its 13th cycle), as follows:

$$b_v\text{base}(k+1,ECT,N,MAP)=b_v\text{base}(k,ECT,N,MAP)+f^*(\hat{b}_v(k)-b_v\text{base}(k,ECT,MAP))\text{cbase}(k+1,ECT,N,MAP)=\text{cbase}(k,ECT,N,MAP)+f^*(\hat{c}(k)-\text{cbase}(k,ECT,N,MAP)) \quad (1),$$

where $f$ is the learning gain and k is the engine cycle index. For values of the indices (which describe engine operating condition) which are not explicitly in the table, the nearest values present in the table can be chosen (or an interpolation can be performed, although the amount of computation increases quickly since the estimates $\hat{c}$ 223 and $\hat{b}_v$ 225 provided by the real-time parameter adaptation algorithm are updated every engine cycle).

Typically, for gain scheduling, a range of values is defined for a given table index. For example, for 60<ECT<80, table location 7 is indexed to find the appropriate gain value. When this means of gain scheduling is used the learning algorithm would also update the value in table location 7 per equation (1). Alternatively, interpolation can be used between adjacent values in the table. For example if a parameter y(x) is defined as a function of abscissa x, and x(i)=d, and x(i+1)=e are defined as a table break points where i is the table index, and d<x<e, then y(x)=y(i)+a*[y(i+1)−y(i)], where a={x−x(i)}/{x(i+1)−x(i)}. This is a standard linear interpolation. The learning algorithm in this case applies a weighted update to the two adjacent table values;

$$y(k+1,i)=y(k,i)+f^*(1-a)^*(\hat{y}(k,x))$$

where $\hat{y}(k)$ is the parameter estimate for the current cycle provided by the parameter adaptation algorithm. Similarly, the stored value at the second breakpoint is defined as:

$$y(k+1,i+1)=y(k,i+1)f^*a^*\{\hat{y}(k)-y(k,x)\}$$

Note that a higher order interpolation could be used without departing from the fundamental teaching of this embodiment. Furthermore, these computations could also be performed shifted in time relative to the equations shown without departing from the fundamental teaching of this embodiment. This learning process extends the durability of emissions control, because it maintains the accuracy of the tuning of the open-loop wall-wetting compensation as the engine ages and changes. This approach will help maintain accurate fuel compensation during engine startup conditions (i.e. during open-loop engine operation) resulting in minimizing hydrocarbon emissions. The herein-described approach differs from the prior art in that a real-time algorithm identifies the wall-wetting or other dynamic parameters while the engine's control system is operating in a closed-loop configuration, and these wall-wetting parameters are learned and stored in a table for later use for operating the engine in an open-loop configuration when the sensory information necessary for closed-loop operation is just not available.

FIG. 3 shows the effect of intake valve deposits on non-adaptive-learning open-loop air/fuel ratio control. FIG. 3 is a chart illustrating the effect of mapped wall-wetting compensation on open-loop transient air/fuel ratio without engine intake valve deposits vs. the effect of mapped non-adaptive-learning wall-wetting compensation on open-loop transient air/fuel ratio for identical throttle transients on the same engine in the presence of engine intake valve deposits. The air/fuel ratio responses depicted in FIG. 3 are characteristic of a steady-state engine operating condition, followed by a rapid transient to a new steady-state engine operating condition, followed by a rapid transient to a new steady-state engine operating condition. The small lean excursion 302 in FIG. 3 is characteristic of the non-adaptive-learning mapped wall-wetting compensator for a throttle transient without engine intake valve deposits being present and with the non-adaptive-learning mapped compensator being properly tuned. The nature of the well-tuned air-fuel ratio control is evidenced by the low peak excursion and the rapid return to a stoichiometric air/fuel mixture. The large lean excursion occurring during the acceleration transient 301 is characteristic of a poorly tuned mapped compensator, which can be caused by engine intake valve deposits. Note that an ideal, or target value for lambda is 1, as shown at reference number 305. For an engine transient in the presence of engine intake valve deposits, the mapped compensator assumes that far less fuel will be deposited in the puddle than is actually the case or that the rate of vaporization of the fuel puddle is higher than is actually the case. This results in an insufficient amount of fuel being injected into the intake port, resulting in a large lean excursion during the acceleration transient. The much larger peak excursion and much longer time to return to a stoichiometric air/fuel mixture show the degraded performance of the mapped compensator in the presence of intake valve deposits. Similar results hold for a sudden decrease in throttle opening 304 (non-adaptive-learning mapped compensator without engine intake valve deposits and) 303 (non-adaptive-learning mapped compensator with engine intake valve deposits). The wall-wetting dynamic effects caused by the rapid throttle closing are inadequately compensated by the non-adaptive-learning mapped compensator in the presence of engine intake valve deposits. The degraded air/fuel control evidenced by large excursions away from stoichiometry directly results in increased automotive exhaust emissions.

The changes in the fuel dynamics caused by intake valve deposits make the non-adaptive-learning mapped compensator less accurate in maintaining a stoichiometric air/fuel ratio in the combustion chamber during open-loop operation by rendering the non-adaptive-learning mapped wall-wetting compensation parameters incorrect, resulting in a poorly tuned wall-wetting compensator, which leads to higher emissions. The adaptive-learning algorithm just described identifies these changes on-line and on a cycle-by-cycle basis and learns these changes for use during subsequent open-loop operation, making accurate compensation for these effects possible. This ability is of paramount importance, as the new emissions regulations have extended emissions control durability requirements to 100,000 miles.

System Hardware Platform

FIG. 4 is a schematic diagram of a system hardware platform for executing the preferred method steps. The system includes an engine 400 coupled to a crankshaft 401, coupled to a flywheel 403, which provides engine absolute position information 407 via an encoder 405. This engine absolute position information 407 is used by a controller 409 for synchronization of the preferred method. The controller is preferably constructed comprising a Motorola M68336 microcontroller. The Motorola M68336 microcontroller is programmed to execute the preferred method steps described later in the attached flow charts. Many other implementations are possible without departing from the essential teaching of this embodiment. For instance another microcontroller could be used. Additionally, a dedicated hardware circuit could also be designed to emulate the preferred method steps described later. Alternatively, a control system, controlled in accordance with the teachings of this treatise, could be used for estimating fuel puddle dynamics real-time and updating open-loop fueling parameter tables based on this information.

Returning to FIG. 4, the engine 400 includes a first cylinder bank 411, which through an exhaust manifold, drives an exhaust gas sensor 413. This sensor 413 can be an oxygen sensor, or any sensor that measures a concentration of an exhausted gas. The engine 400 has an inlet manifold absolute pressure (MAP) sensor 421 coupled to an intake manifold of the engine 400. The inlet manifold absolute pressure sensor 421 provides an output signal 418 indicative of an air charge mass density, to the controller 409. The controller 409 has a bank of output signals 419 which are individually fed to fuel injectors associated with each cylinder in the first and second cylinder banks 411 and 415.

The exhaust gas sensor signal 414, the intake manifold absolute pressure signal 418, and a stored value of the injected fuel charge commanded by the controller 409 (internal to the controller) are used to identify the wall-wetting parameters on a cycle-by-cycle basis. These estimates of the wall-wetting parameters are then passed to the learning algorithm (internal to the controller 409) in order to execute the preferred embodiment.

Figure 5:
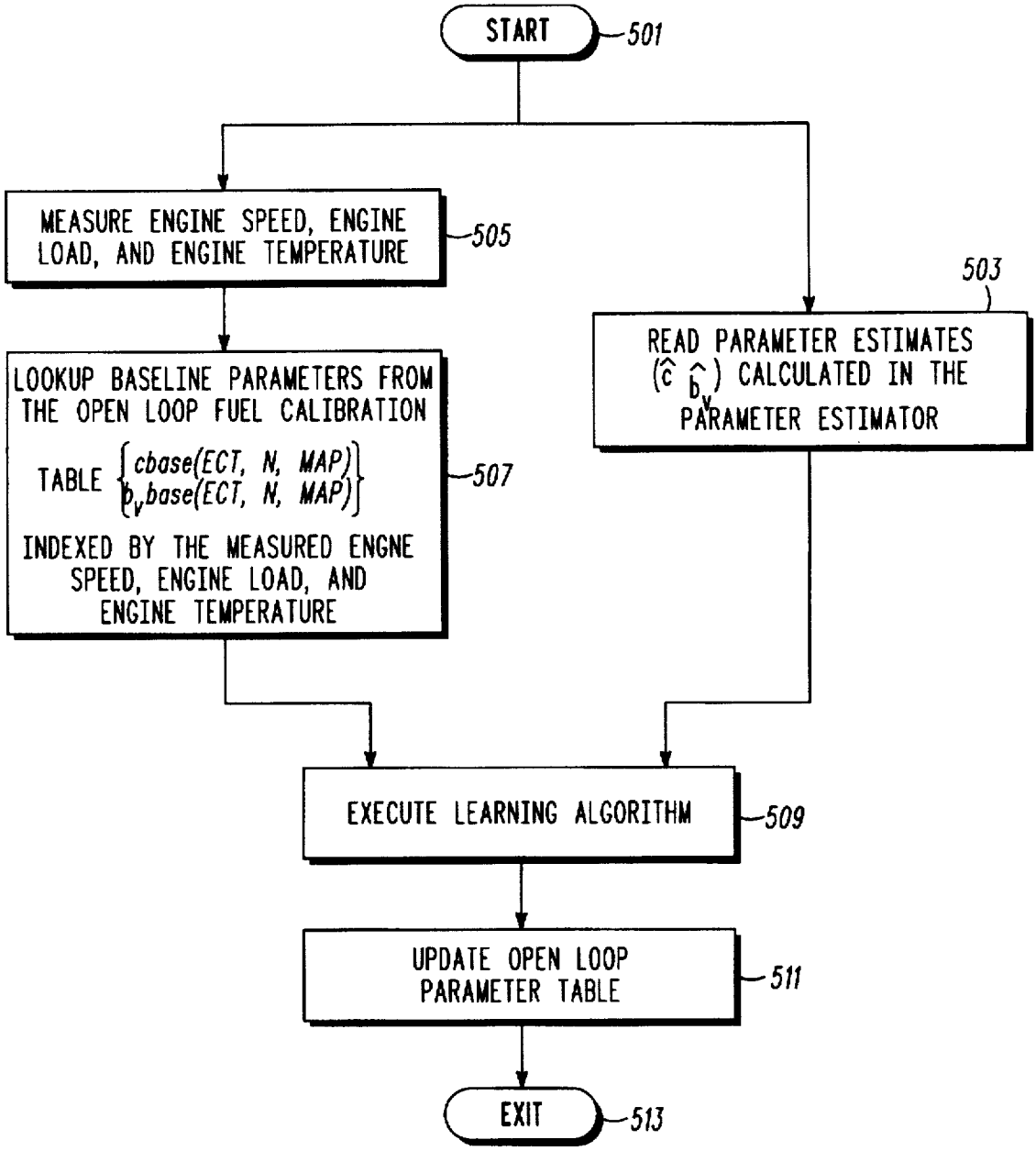
FIG. 5 shows a flow chart that is used to illustrate a portion of the preferred method.

FIG. 5 shows a flow chart which is used to implement a portion of the preferred method. As mentioned earlier the Motorola M68336 microcontroller in the controller 409 is programmed to execute the preferred method steps described in FIG. 5, and also the method steps shown in FIG. 6.

A routine 500 essentially teaches a method for updating the base open-loop fuel parameter table 229 and commences at a start step 501. Note that the routine 500 is executed when the controller 409 is operating the engine 400 in a closed-loop mode.

In step 505 various engine operating conditions are measured using the sensors 405,413,423 (ECT) and 421 introduced in FIG. 4 earlier. These parameters include engine speed (N), engine load (MAP), and engine temperature. In some applications it may be advantageous to measure (and map out the wall-wetting parameters) using other engine operating variables, while in other applications fewer measured operating variables will be useful.

Then, in step 507 the base wall-wetting parameter estimates for c and $b_v$ are looked-up in the (previously stored) base open-loop fuel parameter table 229. The resulting looked up values cbase and $b_v$base are passed to a learning algorithm step 509.

In step 503 the on-line parameter estimates $\hat{c}$ 223 and $\hat{b}_v$ 225, provided by the parameter adaptation algorithm 221 introduced in FIG. 2 are also passed to the learning algorithm step 509.

Next, in step 509, the learning algorithm is executed according to Equation (1), which supplies updated estimates of the wall-wetting parameters c and $b_v$ respectively dependent on the values identified by the on-line algorithm and the previously stored table-based c and $b_v$ values.

Then, in step 511 the base open-loop fuel parameter table 229 is updated to reflect the updated estimates of the wall-wetting parameters c and $b_v$.

Then, in step 513, the routine 500 is exited. Next, the details of the learning algorithm step 509 will be introduced.

Figure 6:
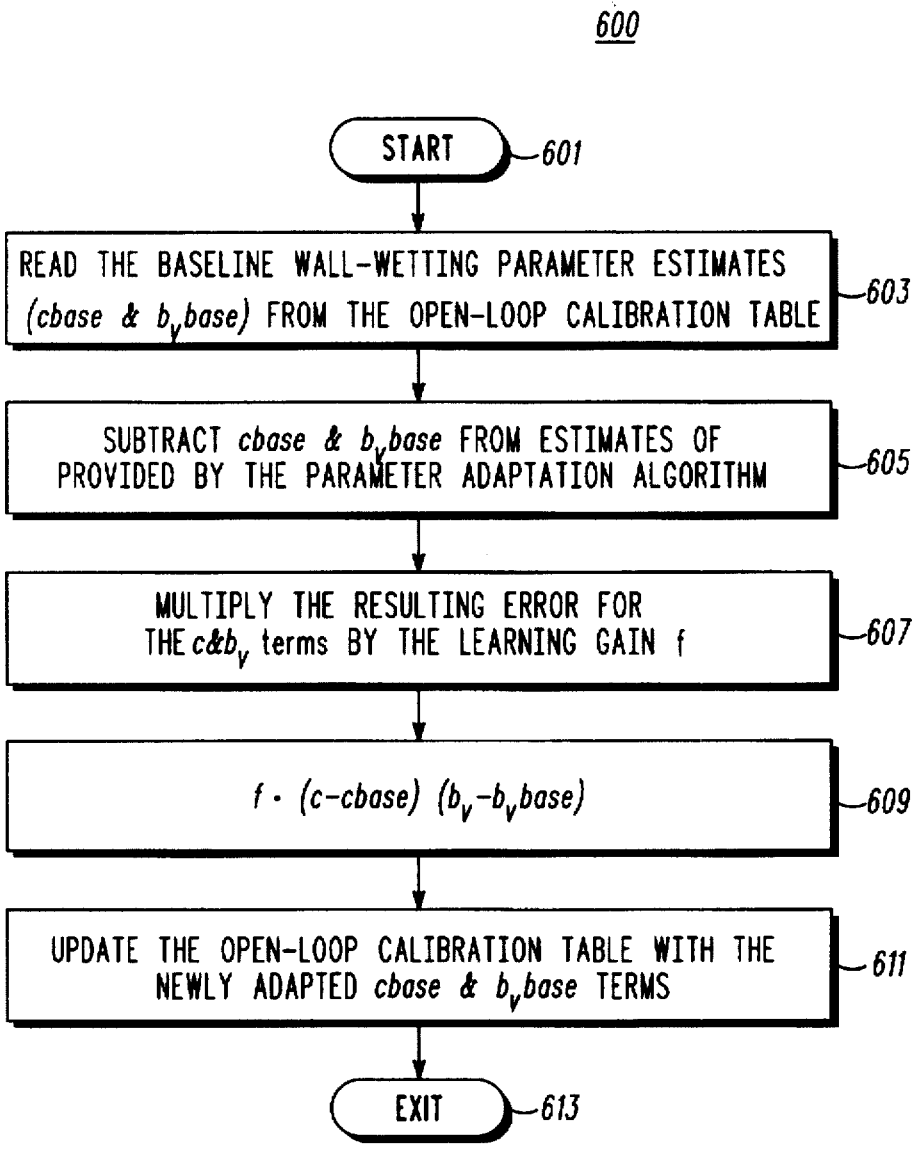
FIG. 6 is a schematic diagram detailing a continuously executing learning algorithm step introduced in FIG. 5.

FIG. 6 is a flow chart detailing the learning algorithm step introduced in FIG. 5.

A routine 600 essentially teaches a method of executing the learning algorithm step 509 and commences at a start step 601. Note that the routine 600 is executed when the controller 409 is operating the engine 400 in a closed-loop mode.

In step 603, the base wall-wetting parameter estimates cbase(k,ECT,N,MAP) and $b_v$base(k,ECT,N,MAP) are provided by the open-loop fuel parameter table 229.

In step 605, cbase(ECT,N,MAP) and $b_v$base(ECT,N,MAP) are subtracted from the real-time parameter estimates $\hat{c}(k)$ 223 and $\hat{b}_v(k)$ 225 provided by the real-time parameter adaptation algorithm 221.

In step 607, the result of step 605 is then multiplied by a learning gain $f$.

In step 609, the result of step 607 is then added to the base wall-wetting parameter estimates cbase(ECT,N,MAP) and $b_v$base(ECT,N,MAP) provided by the open-loop fuel parameter table 229.

In step 611, the open-loop fuel parameter table 229 is updated with the result of step 609 (the new estimates of the baseline wall-wetting parameters cbase(k+1,ECT,N,MAP) and $b_v$base(k+1,ECT,N,MAP) are stored as a function of engine operating condition). The routine then ends in step 613.

Note that an alternative to steps 609 and 611 would be to simply add the output of step 607 to the base open-loop fuel parameter table 229 directly (the two operations are mathematically equivalent) and the embodiment requiring the one extra computation is shown here for reasons of clarity. This process is executed every engine cycle and extends emissions durability over the prior art by keeping the open-loop fuel calibration in tune with time-varying wall-wetting dynamics.

In summary, a more accurate cold start fuel compensation approach for a spark ignition engine that adjusts for engine age and intake valve deposits has been described. By applying a powerful real-time wall-wetting parameter estimation algorithm while the engine is operating in a closed-loop control mode, very accurate estimates of intake system fuel puddling and evaporation dynamic parameters can be made. By learning the parameter estimates, an open-loop control compensator can be adjusted for current estimates of wall-wetting parameters, a very accurate amount of fuel can be delivered. Applying the described approach significantly improves emissions performance while the engine is operating under open-loop control. Since emissions are governed by regulations, this approach has a vital impact on engine performance—particularly under cold starting conditions (where the engine is necessarily operated in an open-loop control mode).

What is claimed is:

1. A method for fuel delivery to an engine comprising the steps of:

measuring when an exhaust gas sensor is in a non-lit-off condition;

identifying when the exhaust gas sensor is in a lit-off condition;

estimating fuel puddle dynamics for an intake system of the engine when the exhaust gas sensor is in the lit-off condition as determined in the step of identifying; and updating an open-loop fuel parameter table dependent on the fuel puddle dynamics estimated in the step of estimating; and adjusting fuel delivery to the engine dependent on the fuel puddle dynamics estimated in the step of estimating when the exhaust gas sensor is in the lit-off condition as determined in the step of identifying, and adjusting fuel delivery to the engine dependent on the open-loop fuel parameter table, updated in the step of updating, when the exhaust gas sensor is in the non-lit-off condition as determined in the step of measuring.

2. A method in accordance with claim 1 wherein the step of updating comprises the steps of:

measuring one or more engine operating conditions selected from the group of engine speed, engine load, and engine temperature; and updating the open-loop fuel parameter table dependent on the fuel puddle dynamics estimated in the step of estimating and indexed by the one or more engine operating conditions selected in the step of measuring.

3. A method in accordance with claim 1 wherein the step of identifying comprises measuring behavior of an exhaust gas sensor to determine when the exhaust gas sensor is in a lit-off condition.

4. A method in accordance with claim 1 wherein the step of measuring comprises the step of measuring an engine temperature to determine when the exhaust gas sensor is in a lit-off condition.

5. A method in accordance with claim 1 wherein the step of measuring comprises the step of measuring a time to determine when the exhaust gas sensor is in a lit-off condition.

6. A method in accordance with claim 1 wherein the step of estimating fuel puddle dynamics comprises the steps of:

measuring a fuel injected into the engine;

measuring a gas concentration exhausted from the engine; and calculating a parameter $\hat{c}(k)$ representing a mass fraction of fuel that adheres to a fuel intake system on a given engine cycle, and calculating a parameter $\hat{b}_v(k)$ representing a mass fraction of the adhered fuel that evaporates from the fuel intake system on the given engine cycle.

7. A method in accordance with claim 6 wherein the step of updating comprises the step of updating the open-loop fuel parameter table using the following deterministic relationship:

$$b_v\text{base}(k+1,ECT,N,MAP)=b_v\text{base}(k,ECT,N,MAP)+f*(\hat{b}_v(k)-b_v\text{base}(k,ECT,N,MAP))\ \text{cbase}(k+1,ECT,N,MAP)=\text{cbase}(k,ECT,N,MAP)+f*(\hat{c}(k)-\text{cbase}(k,ECT,N,MAP))$$

where:

cbase is the updated open-loop fuel puddle estimate representing the mass fraction of the fuel that adheres to the fuel intake system on the given engine cycle;

$b_v$base is the updated open-loop fuel puddle estimate representing the mass fraction of the adhered fuel that evaporates from the fuel intake system on the given engine cycle;

k is an engine cycle index; and $f$ is a learning gain term.

8. A method for fuel delivery to an engine comprising the steps of:

measuring when an exhaust gas sensor is in a non-lit-off condition by measuring behavior of a signal associated with the exhaust gas sensor;

identifying when the exhaust gas sensor is in a lit-off condition by measuring behavior of a signal associated with the exhaust gas sensor;

estimating fuel puddle dynamics for an intake system of the engine when the exhaust gas sensor is in the lit-off condition as determined in the step of identifying; and measuring one or more engine operating conditions selected from a group of engine speed, engine load, and engine temperature;

updating the open-loop fuel parameter table dependent on the fuel puddle dynamics estimated in the step of estimating and indexed by the one or more engine operating conditions selected in the step of measuring; and adjusting fuel delivery to the engine dependent on the fuel puddle dynamics estimated in the step of estimating when the exhaust gas sensor is in the lit-off condition as determined in the step of identifying, and adjusting fuel delivery to the engine dependent on the open-loop fuel parameter table, updated in the step of updating, when the exhaust gas sensor is in the non-lit-off condition as determined in the step of measuring.

9. A method in accordance with claim 8 wherein the step of estimating fuel puddle dynamics comprises the steps of:

measuring a fuel injected into the engine;

measuring a gas concentration exhausted from the engine; and calculating a parameter $\hat{c}(k)$ representing a mass fraction of fuel that adheres to a fuel intake system on a given engine cycle, and calculating a parameter $\hat{b}_v(k)$ representing a mass fraction of the adhered fuel that evaporates from the fuel intake system on the given engine cycle.

10. A method in accordance with claim 9 wherein the step of updating comprises the step of updating the open-loop fuel parameter table using the following deterministic relationship:

$$b_v\text{base}(k+1,ECT,N,MAP)=b_v\text{base}(k,ECT,N,MAP)+f*(\hat{b}_v(k)-b_v\text{base}(k,ECT,N,MAP))\ \text{cbase}(k+1,ECT,N,MAP)=\text{cbase}(k,ECT,N,MAP)+f*(\hat{c}(k)-\text{cbase}(k,ECT,N,MAP))$$

where:

cbase is the updated open-loop fuel puddle estimate representing the mass fraction of the fuel that adheres to the fuel intake system on the given engine cycle;

$b_v$base is the updated open-loop fuel puddle estimate representing the mass fraction of the adhered fuel that evaporates from the fuel intake system on the given engine cycle;

k is an engine cycle index; and $f$ is a learning gain term.

11. A system for fuel delivery to an engine comprising:

an exhaust gas measurement device for measuring when an exhaust gas sensor is in a non-lit-off condition, and when the exhaust gas sensor is in a lit-off condition; and a control device estimates fuel puddle dynamics for an intake system of the engine when the exhaust gas sensor is in the lit-off condition and adapts an open-loop fuel parameter table dependent on the estimated fuel puddle dynamics, wherein the control device adjusts fuel delivery to the engine dependent on the fuel puddle dynamics when the exhaust gas sensor is in the lit-off condition, and adjusts fuel delivery to the engine dependent on the open-loop fuel parameter table when the exhaust gas sensor is in the non-lit-off condition.

12. A system in accordance with claim 11 further comprising:

an engine speed measurement device having an output providing an engine speed signal indicative of a rotational speed of the engine;

an engine load measurement device having an output providing an engine load signal indicative of a load on the engine;

an engine temperature measurement device having an output providing an engine temperature signal indicative of a temperature of the engine; and wherein the control device adapts the open-loop fuel parameter table dependent on the estimated fuel puddle dynamics, and at least one of the engine speed signal, the engine load signal, and the engine temperature signal.

* * * * *